United States Patent [19]

Gaupp et al.

[11] 4,445,019

[45] Apr. 24, 1984

[54] COMPRESSED-GAS SWITCH

[75] Inventors: Osvin Gaupp, Wettingen; Thomas Gysel, Veltheim; Georg Köppl, Birr, all of Switzerland

[73] Assignee: BBC Brown, Boveri & Company, Limited, Baden, Switzerland

[21] Appl. No.: 445,759

[22] Filed: Nov. 30, 1982

[30] Foreign Application Priority Data

Dec. 3, 1981 [CH] Switzerland ..... 7731/81

[51] Int. Cl.[3] ..... H01H 33/88

[52] U.S. Cl. ..... 200/148 A; 200/148 R

[58] Field of Search ..... 200/148 A, 148 R, 148 B

*Primary Examiner*—Robert S. Macon

*Attorney, Agent, or Firm*—Burns, Doane, Swecker & Mathis

[57] ABSTRACT

A compressed-gas switch has a stationary and a movable switching part. At the movable switching part a nozzle of insulating material and an annular element consisting of insulating material are provided. The nozzle of insulating material and the annular element delimit an outer inlet duct and an annular element and a burn-off contact of the movable switching part delimit an inner inlet duct. The inlet ducts are connected to a compression space, filled with quenching gas, of a piston-cylinder device which can be actuated by the movable switching part. During a switching-off process the quenching gas, which is under high pressure in the compression space, is conducted by the inner and outer ducts, into the switching path. This switch is now to be developed further in such a way that both short-circuit currents at a distance and those at the terminals can be switched off with high reliability. This is achieved by making the minimum flow cross-section of the outer inlet duct smaller than the minimum flow cross-section of the inner inlet duct and by attaching at the narrowest point of the annular element a conductive ring with the clear width of the conductive ring smaller than the clear width of the annular element.

4 Claims, 2 Drawing Figures

COMPRESSED-GAS SWITCH

BACKGROUND AND SUMMARY OF THE PRESENT INVENTION

The invention relates to an improved compressed-gas switch having two switching parts which are movable relative to one another.

A switch of this general type is known for instance from German Offenlegungsschrift No. 2,930,839. In this switch, the minimum flow cross-section of the inner inlet duct is not only considerably smaller than that of the outer inlet duct but, in addition, the inner inlet duct is also connected to a space in which the quenching gas has a significantly higher pressure during a switching-off process than in the space connected to the outer inlet duct. The quenching gas blowing onto the arc during the switching-off process, therefore, has a much higher velocity in the region of the outlet opening from the inner inlet duct than in the region of the outlet opening from the outer inlet duct. The root of the switching arc is driven by the quenching gas component with the high outlet velocity into the hollow burn-off contact of the first switching part and in conjunction with the quenching gas component with the lower outlet velocity a turbulence is produced in the arc gases thus resulting at the quenching of the arc. When short-circuit currents in the terminals are being quenched, however, it is possible that difficulties will occur since the switching path has not yet been optimally dielectrically restabilized after the quenching of the switching arc before the returning voltage appears.

The invention has an object of further developing the generic switch in such a manner that short-circuit currents at a distance and those at the terminals can be switched off with high reliability.

This object and others are achieved by the switch according to the invention. The switch is distinguished by the fact that the nozzle of insulating material can be greatly stressed thermally and dielectrically at its surface facing the switching path and that simultaneously in the switching path the pressure of the quenching gas is distributed in a manner optimum for controlling the returning voltage in the case of short-circuits at a distance and at the terminals.

BRIEF DESCRIPTION OF THE DRAWINGS

For the purpose of explaining the invention in greater detail, in the text which follows an illustrative embodiment is explained in greater detail with reference to the accompanying drawings in which like members bear like reference numerals and in which.

DETAILED DESCRIPTION OF THE PREFERRED EMBODIMENTS

Figure 1:
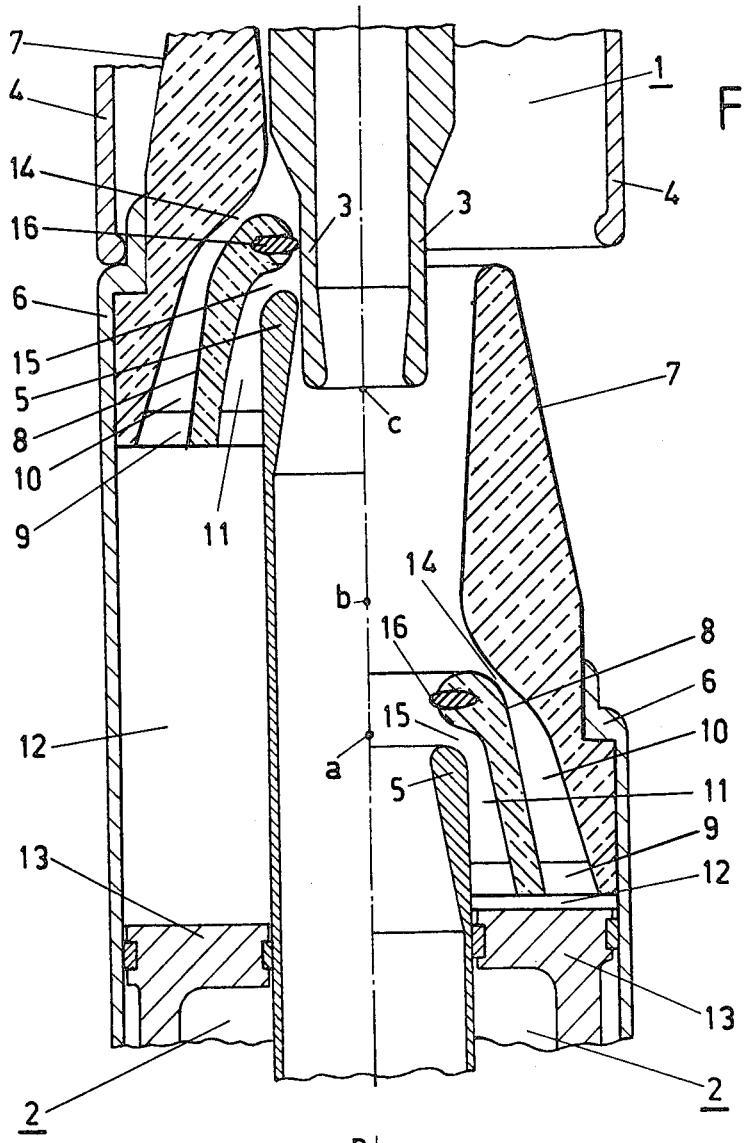
FIG. 1 is a top view of a section through the contact arrangement of a switch constructed in accordance with the invention in which in the left-hand half the switched-on position and in the right-hand half the switched-off position of the switch is shown.

With reference to FIG. 1, the contact arrangement, located in a housing (not shown) filled with insulating gas, of a compressed-gas switch is constructed according to the invention which in its basic construction has a stationary switching part 1 and a movable switching part 2. The stationary switching part 1 has a burn-off contact 3 which is, for example, constructed to be hollow and a nominal-current contact 4 surrounding this burn-off contact and the movable switching part 2 has a hollow burn-off contact 5 and a nominal-current contact 6 surrounding this burn-off contact. At the nominal-current contact 6 of the movable switching part 2 a nozzle 7 of insulating material, consisting preferably of polytetrafluoroethylene, is mounted between the internal surface of which, located upstream of the nozzle constriction and the external surface of an annular element 8 preferably also consisting of polytetrafluoroethylene, an annular inlet duct 10 is recessed. The annular element 8 is arranged on webs 9 which are mounted between the movable burn-off contact 5 and the movable nominal-current contact 6. The webs 9 are separated from one another by gas passages which effect the connections between the inlet duct 10 and an annular inlet duct 11. The annular inlet duct is delimited by the internal surface of the annular element 8 and the external surface of the movable burn-off contact 5, having a compression space 12 of a piston-cylinder compression device the stationary piston of which is designated by 13. The annular inlet ducts 10 and 11 taper in the downstream direction and have minimum flow cross-sections 14 and 15 shortly before their downstream ends. Between the downstream ends of the inlet ducts 10 and 11 at the narrowest point of the annular element 8, a conductive ring 16 preferably consisting of contact material resistant to burning off is attached. The clear width of the conductive ring 16 is less than that of the annular element 8. The total contact arrangement is filled with a quenching gas, preferably sulfur hexafluoride, with a pressure of a few bar.

Figure 2:
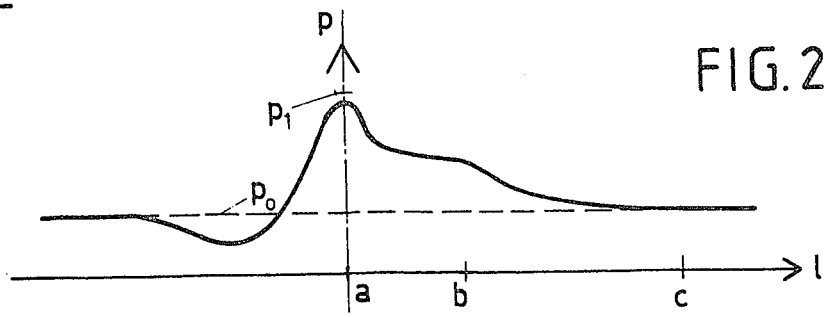
FIG. 2 is a graph of the operational characteristic of the quenching gas pressure p occurring along the switch axis 1 during a switching-off process.

Now, the switch according to the invention functions as follows:

In the switched-on position of the switch the stationary burn-off contact 3 fits through the nozzle 7 of insulating material, the conductive ring 16 and the upper part of the movable burn-off contact 5 in such a manner that the inlet ducts 10 and 11 are closed. If now in the course of the switching off movement the movable switching part 2 and thus the nozzle 7 of insulating material attached to it, and the annular element 8 are moved downwards, the quenching gas is first precompressed in the compression space 12 and the annular inlet ducts 10 and 11. After a certain time, the nominal-current contacts 4 and 6 begin to separate from each other and the current to be switched off is conducted via the burn-off contacts 3 and 5. As soon as the burn-off contacts 3 and 5 separate from each other, a switching arc, not shown, is drawn and from the inside inlet duct 11 a flow of quenching gas commences which drives the arc into the burn-off contacts 3 and 5. If now the stationary burn-off contact 3 releases the opening of the outside inlet duct 10, an additional blowing onto the arc commences and the quenching gas consumed is now removed not only through the hollow burn-off contacts 3 and 5 but also through the constriction of the nozzle 7 of insulating material. The dimensions of the minimum flow cross-sections 14 and 15 of the annular inlet ducts 10 and 11 are now such that the pressure contour shown in FIG. 2 is produced. In this contour, the quenching gas pressures p existing along the switch axis 1 shortly before the switching-off position is reached are given. Here $p_O$ denotes the pressure of the uncompressed quenching gas and $p_1$ the pressure of the quenching gas in the compression space 12. As can be seen from FIG. 1 the locations a, b, c on the switch axis are located successively in the regions of the outlet opening of the inside inlet duct 11, constriction of the nozzle 7 of insulating material and the free end of the stationary burn-off contact 3. At location a the pressure approximately reaches the value $p_1$ whereas at location b approximately twice the value of the pressure of $p_O$ exists.

Such a pressure distribution has the effect that because of the pressure peak provided at a the ionised particles are rapidly removed from the part of the switching path located in the region of the outlet opening of the inlet duct 11. This makes it possible to achieve reliable control of the voltage peaks occurring during the switching off of short-circuit currents at a distance. The flat pressure distribution caused by the blowing from the outside inlet duct 10 creates in the whole switching path a uniformly high dielectric strength which makes it possible for the high recurring voltages occurring during the switching of short-circuit currents at the terminals to be absorbed by the switching path without problems. The desired pressure distribution along the switch axis sketched above is achieved by making the minimum flow cross section 14 of the outer inlet duct 10 smaller than the minimum flow cross-section 15 of the inner inlet duct 11. It is particularly recommendable that the minimum flow cross-section 15 of the inner inlet duct 11 be dimensioned to be 1.5 to 4 times the minimum flow cross-section 14 of the outer inlet duct 10.

It has also been successful to construct the piston 13 of the compression device as a stepless ring piston since then the eddy space of the compressed quenching gas is minimum.

The conductive ring 16 not only provides the sealing of the inside inlet duct 11 with respect to the upper part of the switching path as required in the initial phase of the switching-off process but also has the effect that after the constriction of this ring is released, the switching arc does not directly contact the insulating material of the annular element 8. Further, the ring 16 simultaneously homogenises the electric field of the switching path because of capacity feedback to the burn-off contacts 3 and 5. As a result of this homogenisation of the electric field of the switching path, the risk of forming leakage currents and glow discharges on the thermally and dielectrically heavily loaded surface of the nozzle 7 of insulating material, is considerably reduced, even in the case of extreme stresses.

The principles, preferred embodiments and mode of operation of the present invention have been described in the foregoing specification. However, the invention which is intended to be protected is not to be construed as limited to the particular embodiments disclosed. The embodiments are to be regarded as illustrative rather than restrictive. Variations and changes may be made by others without departing from the spirit of the present invention. Accordingly, it is expressly intended that all such variations and changes which fall within the spirit and scope of the present invention as defined in the claims be embraced thereby.

We claim:

1. A compressed-gas switch having two switching parts which are movable with respect to one another, comprising a first switching part provided with a burn-off contact of hollow construction and connected to a nozzle of insulating material, a burn-off contact of a second switching part fitting into the constriction of the nozzle, a blow duct being provided in the nozzle and being connected to a space containing compressed quenching gas and to an annular element of insulating material, the annular element subdividing the blow duct into an inner and an outer annular inlet duct with differing minimum flow cross-sections, the minimum flow cross-section of the outer inlet duct being smaller than the minimum flow cross section of the inner inlet duct, and a conductive ring attached at the narrowest point of the annular element, a clear width of the conductive ring being smaller than the clear width of the annular element.

2. A compressed-gas switch as claimed in claim 1, wherein the minimum flow cross-section of the inner inlet duct is 1.5 to 4 times that of the minimum flow cross-section of the outer inlet duct.

3. A compressed-gas switch as claimed in claim 1, wherein the quenching gas located in the compression space is compressed by a ring piston constructed to be stepless.

4. A compressed-gas switch as claimed in claim 2, wherein the quenching gas located in the compression space is compressed by a ring piston constructed to be stepless.

* * * * *